33-233 SR
3/19/85 OR 4,505,047

United States Patent [19]

Elbe

[11] Patent Number: 4,505,047

[45] Date of Patent: Mar. 19, 1985

[54] FRONT SIGHT FOR SMALL ARMS

[76] Inventor: Ronald E. Elbe, 1315 W. 57 St., Davenport, Iowa 52806

[21] Appl. No.: 930,827

[22] Filed: Aug. 3, 1978

[51] Int. Cl.[3] ..... F41G 1/02

[52] U.S. Cl. ..... 33/233; 33/234; 33/244

[58] Field of Search ..... 33/233, 234, 243, 244; D22/8; 42/15

[56] References Cited

U.S. PATENT DOCUMENTS 1,043,678 11/1912 De Bertouch ..... 33/243
1,329,075 1/1920 Fornonzini ..... 33/243

*Primary Examiner*—Willis Little
*Attorney, Agent, or Firm*—Anthony T. Lane; Robert P. Gibson; Robert O. Richardson

[57] ABSTRACT

A front sight for handguns having side vanes for shading the sighting surface from undesirable reflections, and providing ramps to prevent the sight from snagging when used with a holster.

1 Claim, 14 Drawing Figures

FRONT SIGHT FOR SMALL ARMS

GOVERNMENT RIGHTS

The invention described herein may be manufactured and/or used by or for the Government for governmental purposes without the payment of any royalty thereon.

BACKGROUND OF THE INVENTION

Sights on handguns typically consist of two blades. A longitudinal blade situated at or near the muzzle end of the barrel and a transverse notched blade situated as far rearward on the weapon as is practical. These are commonly referred to as front and rear sights respectively. The weapon is held at arms length in front of the shooter. The front sight is then centered in the notch in the rear sight and the top surface of both sights aligned. The intended target should appear to sit directly on top of the sights. It should be noted that the shape of the front sight can have a significant effect on sighting capability.

There are currently three basic front sight configurations for handguns. These are ramp, undercut, and vertical. Each of these styles of front sights has significant advantages and disadvantages. The ramp sight is shaped much like a ramp from the barrel to the top of the sight. This style of front sight is ideally suited for use with a holster or for field or combat use. This is because the sight will not snag in the holster or on brush, clothing, etc. Unfortunately, the glare from the ramp front sight makes it practically useless as a sight on many occasions. The undercut sight is angled just the opposite of the ramp sight. In other words, the top of the sighting surface is closest to the shooter's eye. This sight offers an excellent sight picture because the sighting surface is shaded from the sun's glare. On the other hand, the undercut sight is not practical for field use since it is prone to snagging. The vertical sight, as the same implies, has a vertical sighting surface. This sight is a combination of the worst features of both the ramp and undercut sights.

SUMMARY OF THE PRESENT INVENTION

The present invention is a front sight for handguns which incorporates the optical advantages of an undercut sight and the practical advantages of a ramp sight. That is, this sight offers as good or better sight picture as an undercut sight while still lending itself for use in the field or with a holster.

This sight could take many forms. Probably one of the best would be similar to the undercut sight to provide the best sight picture but with two very thin ramps on either side of the sight blade. These ramps serve, in part, the same function as a conventional ramp sight. A weapon equipped with such a sight could then be used with a holster or in the field without fear of snagging. Additionally, the side ramps shield the sighting surface between them from harmful side lights, thus eliminating glare on the sight from the side.

BRIEF DESCRIPTION OF DRAWINGS

FIGS. 1*a*–3*a* are partial side elevational views of gun barrels showing different styles of prior art front sights for handguns, FIGS. 1*b*–3*b* are sectional views of the gun barrel showing the sight as seen by the shooter.

DETAILED DESCRIPTION OF ILLUSTRATIVE EMBODIMENTS

Figure 1A:
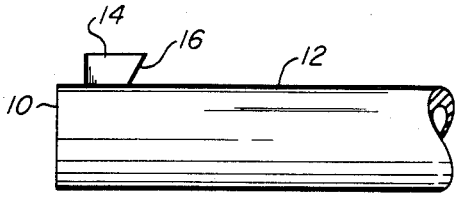
Fig 1a PRIOR ART
Figure 1B:
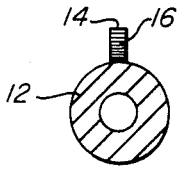
Fig 1b PRIOR ART
Figure 2A:
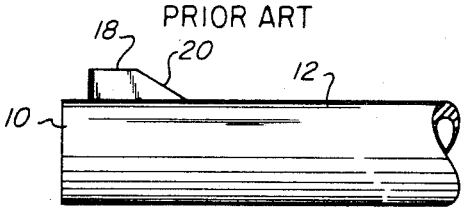
Fig 2a PRIOR ART
Figure 2B:
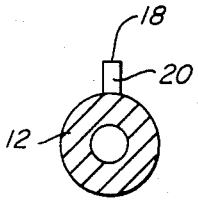
Fig 2b PRIOR ART
Figure 3A:
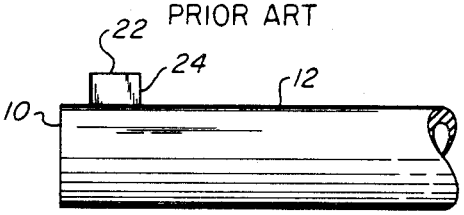
Fig 3a PRIOR ART
Figure 3B:
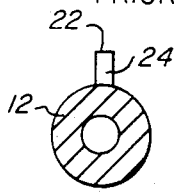
Fig 3b PRIOR ART

FIGS. 1*a* and *b* through FIGS. 3*a* and *b* illustrate the three basic styles of prior art front sight blades for handguns. In each view the sight blades are shown mounted near the muzzle end 10 of a gun barrel 12. FIGS. 1*a*–3*a* show a side elevational view of each type of sight blade. FIGS. 1*b*–3*b* show sectional views through the barrel 12. These views illustrate the sight blades as seen by the shooter. FIGS. 1*a* and *b* show the undercut sight 14. This type of sight is universally used on target guns, FIG. 1*b* illustrates the darkened sighting surface 16 of the sight blade. This sight offers a good sighting picture because light is reflected down toward the barrel rather than toward the shooter's eye. However, the configuration of this sight does not lend itself for use with a holster or in the field. The sighting surface 16 and the adjacent surface of the barrel 12 form a hook which can easily snag brush, clothing, etc.

FIGS. 2*a* and *b* show the ramp style sight 18. The sighting surface 20 provides a smooth transition or "ramp" from the barrel to the top of the front sight blade 18. This eliminates the possibility of snagging and make it ideal for use with a holster or in the field. However, reflections from the sighting surface 20 can, at times, make this style practically useless as a sight. This is because of a blinding effect on the shooter or a distorted appearance of the sight blade 18 due to the reflections.

FIGS. 3*a* and *b* illustrate the vertical style sight blade 22. This style of sight combines the disadvantages of both of the previously discussed sight styles. The sighting surface 24 is prone to snagging in holsters and also produces unwanted reflections.

Figure 4A:
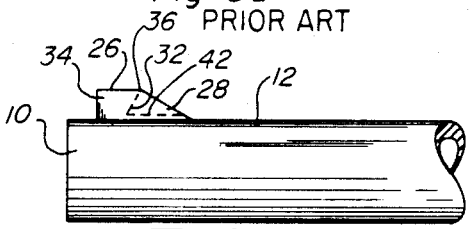
Fig 4a PRIOR ART
FIG. 4*a* is a partial side elevational view of a gun barrel showing a front sight in accordance with the present invention.
Figure 4B:
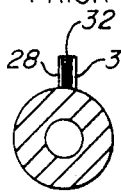
FIG. 4*b* is a sectional view of the gun barrel showing the sight in FIG. 4*a* as seen by the shooter.

FIGS. 4*a* and *b* show a front sight 26 made in accordance with the present invention. This sight utilizes two side vanes 28, 30 to shield the sighting surface 32 on the vertical blade 34 positioned between the vanes. In this embodiment the sighting surface 32 terminates in a horizontal sighting edge 36 and inclines downward in a manner similar to that of the undercut sight 16 shown in FIGS. 1*a* and *b*. This insures that light rays coming from behind the shooter will be reflected down toward the barrel rather than back toward the shooter's eye. Additionally, the side vanes 28, 30 shade the sighting surface 32 from light rays coming from the side. This sight virtually eliminates problems associated with reflections off the sight blade.

Figure 5:
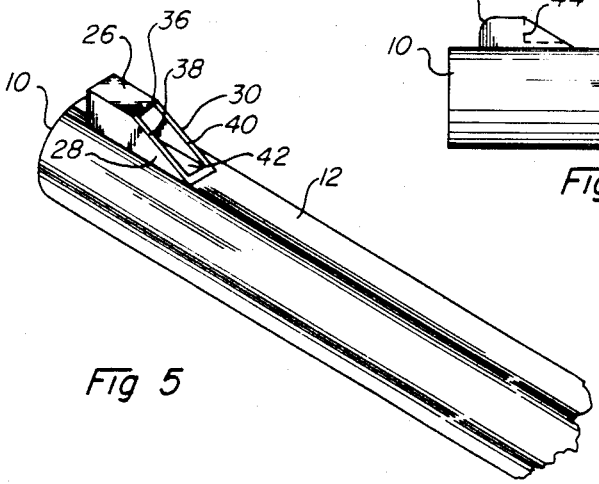
FIG. 5 is a perspective view of the barrel and sight down in FIGS. 4*a* and *b*.

The uppermost surfaces 38, 40 of the side vanes 28, 30 form ramps as shown in FIG. 5. These ramps are similar to that of the ramp style sight 18 shown in FIGS. 2*a* and *b*. The ramps 38, 40 serve to prevent snagging when used with a hoster or in the field. Sight 26 has a base portion 42 extending rearwardly from the lower end of sighting surface 32 and between vanes 28, 30. This base provides rigidity to the sight prior to installation on the barrel 12 and makes the fabrication of the sight by the well-known investment casting technique a most suitable method. This base also makes it easier to bond the sight to the barrel, such as by spot welding for example.

Figure 6:
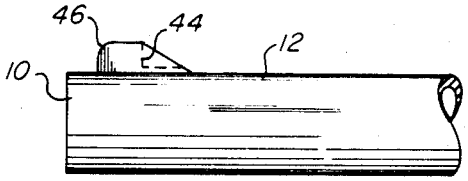
FIG. 6 is a view similar to FIG. 4*a* showing a second embodiment of the present invention.

FIG. 6 shows a second embodiment of the present invention. This embodiment utilizes a vertical sighting surface 44. The side vanes still provide adequate shading of the sighting surface to insure a good sight picture. This embodiment also utilizes a radius 46 on the upper front edge of the sight. This allows smooth, unimpeded insertion into a holster. Such a curved upper front edge may also be used, if desired, in any of the embodiments of this invention. While it is believed to be unnecessary, this curved upper front edge may be replaced, if desired, with forward extending ramp edges similar to rearward extending ramp edges 38, 40 shown in FIG. 5.

Figure 7:
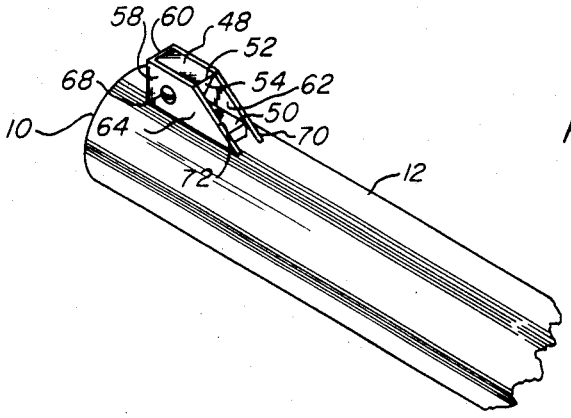
FIG. 7 is a perspective view and FIG. 8 is a plan view showing another embodiment of the present invention.
Figure 8:
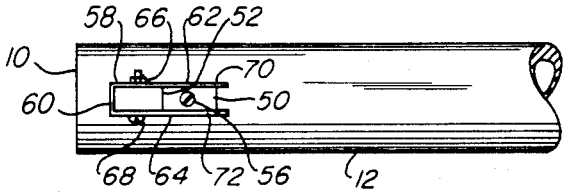

Reference is now made to the embodiment shown in FIGS. 7 and 8. In this embodiment, the existing undercut sight 14 shown in FIGS. 1*a*, 1*b* may be used with wrap-around side vanes to improve the sighting of an existing weapon. In the alternative, an undercut sight 48 with mounting base 50 may be used. Such a sight would have a horizontal sighting edge 52 at the top of forward inclined sighting surface 54. This sight may be attached to barrel 12 by bonding, welding or by screw 56.

A U-shaped wrap-around side vane 58 consisting of a base portion 60 and side legs 62, 64 is fastened to sight 48 by means of a nut 66 and bolt 68 after a hole has been drilled through the sight to receive the bolt. The base portion and side legs have a width equal to the height of sight 48, and the legs extend rearwardly from sight edge 52 with inclined edges 70, 72 abutting the upper surface of barrel 12.

Figure 9:
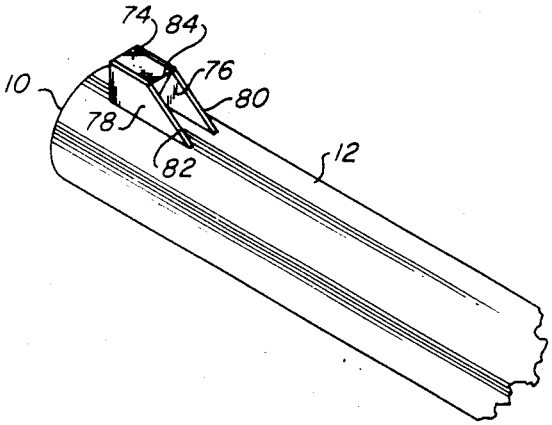
FIG. 9 is a perspective view and FIG. 10 is a plan view showing still another embodiment.
Figure 10:
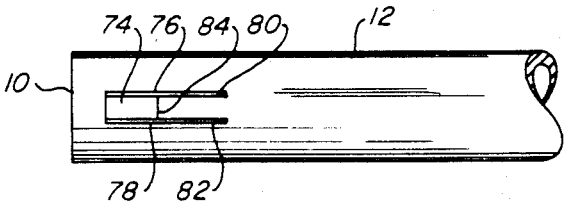

The modification shown in FIGS. 9 and 10 utilize an undercut sight 74 which may already be attached to the gun barrel 12. Side vanes 76, 78 of a width equal to the height of sight 74 have rearwardly inclined edges 80, 82 extending rearwardly from sight edge 84. These vanes are positioned against the sides of sight 74 and bonded or welded to it. The vane edges abutting the barrel 12 may also be secured thereto.

The invention in its broader aspects is not limited to the specific embodiments, improvements and instrumentalities described but departures may be made therefrom within the scope of the accompanying claims without departing from the principles of the invention and without sacrificing its chief advantages.

What is claimed is:

1. A front sight for small arms having side vanes for shading the sighting surface from undesirable reflections with ramps to prevent the sight from snagging, said sight comprising:

a vertical blade extending logitudinally along the top surface of the barrel of said small arms near the muzzle end thereof, said blade having a rear sighting surface extending upwardly and terminating in an upper transverse horizontal sighting edge, said rear sighting surface extending upwardly and rearwardly thereby forming an undercut sight, a pair of ramps of uniform thickness one of which is at each end of said sighting edge extending downwardly from and rearwardly of said sighting surface, said ramps terminating in abuttment with said top surface of said barrel, said blade having a base for attachment to said top surface of said barrel, said base extending between said ramps along the lower edges thereof, said ramps forming the sides of a U-shaped vane, said vane being adapted to fit around the forward surface and extending along and against the side surfaces of said blade, and means securing said ramps of said vane to the side surfaces of said blade.

* * * * *